US006101705A

United States Patent [19]

Wolfson et al.

[11] Patent Number: 6,101,705

[45] Date of Patent: Aug. 15, 2000

[54] METHODS OF FABRICATING TRUE-TIME-DELAY CONTINUOUS TRANSVERSE STUB ARRAY ANTENNAS

[75] Inventors: Ronald I. Wolfson, Los Angeles; William W. Milroy, Playa Del Rey; Stuart B. Coppedge, Manhattan Beach, all of Calif.

[73] Assignee: Raytheon Company, Lexington, Mass.

[21] Appl. No.: 08/972,421

[22] Filed: Nov. 18, 1997

[51] Int. Cl.[7] ..... H01P 11/00

[52] U.S. Cl. ..... 29/600

[58] Field of Search ..... 29/600; 343/789, 343/778, 772, 776, 853; 333/239, 125, 137

[56] References Cited

U.S. PATENT DOCUMENTS

| | | | |
|---|---|---|---|
| 2,628,311 | 2/1953 | Lindenblad | 343/771 |
| 3,761,943 | 9/1973 | Harper et al. | 343/776 |
| 4,527,165 | 7/1985 | Ronde | 343/778 |
| 4,878,060 | 10/1989 | Barbier et al. | 343/778 |
| 5,568,160 | 10/1996 | Collins | 343/778 |
| 5,579,021 | 11/1996 | Lee | 343/781 P |

*Primary Examiner*—Carl J. Arbes

*Attorney, Agent, or Firm*—Leonard A. Alkov; Glenn H. Lenzen, Jr.

[57] ABSTRACT

Methods of fabricating air-dielectric true-time-delay, continuous transverse stub array antenna. The first method uses conventional machining or molding techniques to fabricate layers of plastic with desired microwave circuit features. The plastic layers are then metalized, assembled (aligned) and joined together, such as by using ultrasonic welding techniques. Readily available metalization and ultrasonic welding techniques exist that may be used. The second method uses sheets of metal, into which microwave circuit features are fabricated, such as by machining. The layers are then assembled (aligned) and joined together, using one of several available processes, such as an inert gas, furnace brazing technique, for example.

20 Claims, 6 Drawing Sheets

METHODS OF FABRICATING TRUE-TIME-DELAY CONTINUOUS TRANSVERSE STUB ARRAY ANTENNAS

BACKGROUND

The present invention relates generally to array antennas and their fabrication methods, and more particularly, to methods of fabricating a true-time-delay continuous transverse stub array antenna.

Previous true-time-delay, continuous transverse stub array antennas were made either by machining or molding microwave circuit features out of low-loss plastics, such as Rexolite® or polypropylene. The plastic was then metalized to form a dielectric-filled, over-moded waveguide or parallel-plate waveguide structure. Such antennas are disclosed in U.S. Pat. No. 5,266,961 entitled "Continuous Transverse Element Devices and Methods of Making Same", U.S. patent application Ser. No. 08/885,583, filed Jun. 30, 1997, entitled "Planar Antenna Radiating Structure Exhibiting Quasi-Scan/Frequency Independent Driving-Point Impedance", and U.S. patent application Ser. No. 08/884,837, filed Jun. 30, 1997, entitled "Compact, Ultrawideband, Matched E-Plane Power Divider".

A prototype antenna was developed by the assignee of the present invention using the solid-dielectric approach. The prototype design operates satisfactorily over an extended band of 3.5 to 20.0 GHz. Dielectric parts of uniform cross section were made from Rexolite® 1422 using conventional machining techniques. The parts were bonded together with adhesive and then all outside surfaces except a line-feed input and the radiating aperture were metalized with a highly conductive silver paint.

The primary disadvantage of the solid-dielectric approach is the dielectric loss, which becomes increasingly significant at higher millimeter wave frequencies. Other disadvantages include variations in dielectric properties, such as inhomogeneity and anisotropy, the high cost of premium microwave dielectric materials, and to a lesser extent, the cost of fabrication, bonding and metalization of the dielectric parts. Air-dielectric designs also have problems, and in particular, microwave circuit features are internal to the waveguide structure and may be inaccessible for mechanical inspection after assembly. Thus the processes used to fabricate such antennas must insure accurate registration of parts, maintain close tolerances and provide continuous conducting surfaces across seams in waveguide walls.

Accordingly, it is an objective of the present invention to provide for methods of fabricating air-dielectric, true-time-delay continuous transverse stub array antennas.

SUMMARY OF THE INVENTION

To accomplish the above and other objectives, the present invention provides for methods that may be used to fabricate an air-dielectric, true-time-delay, continuous transverse stub array antenna that addresses the aforementioned problems. The present method involves stacking, alignment and joining of multiple plastic or metal layers that contain microwave circuit features. Prior to final assembly, the individual layers are accessible from both faces, so that detailed features can be added at that time and so that parts can be thoroughly inspected.

The present invention provides for two methods of fabricating air-dielectric versions of a true-time-delay, continuous transverse stub array antenna. The first method uses conventional machining or molding techniques to form layers of plastic with the desired microwave circuit features. The layers are then metalized and bonded together, such as by means of ultrasonic welding techniques. The second method uses sheets of metal, into which microwave circuit features are formed, such as by machining. The layers are then assembled and joined together, using one of several available processes, such as an inert gas, furnace brazing technique, for example.

Air-dielectric microwave structures have several key advantages over solid-dielectric microwave structures, including lower dielectric losses and reduced susceptibility to nonuniformities in the microwave properties of the dielectric material, such as inhomogeneity and anisotropy. Since metallic surfaces of plated plastics are generally smoother at the metal-to-air interface than at the metal-to-plastic interface, conductor losses for air-dielectric structures are typically lower, especially at millimeter wave frequencies.

Further, low-cost plastics with poor microwave characteristics but excellent physical properties, such as acrylonitrile-butadiene-styrene (ABS), may be used to form air-dielectric microwave structures because the RF energy is not required to propagate through the plastic.

The first method of antenna fabrication, involving ultrasonic welding of plastic layers that have been metalized, is particularly attractive for high volume, low-cost antennas where the various layers can be fabricated from ABS using conventional injection molding techniques. The metalization can be applied by a variety of processes, such as vacuum deposition, electroless plating, or by lamination during injection molding.

The second method of antenna fabrication, involving machined aluminum layers that are brazed together, is better suited for applications that can afford higher manufacturing costs in order to obtain close-tolerance microwave features and a more rugged mechanical design. The walls of the internal waveguide structure can be electroless plated after brazing to reduce conductor losses.

The layered structures described herein are generally useful in ultrawideband antenna feed and aperture architectures used in true-time-delay, continuous transverse stub array antennas. Several fabrication techniques that can be used include injection molding of plastics and numerically-controlled machining, casting or stamping of metal sheets. These processes are mature, and they yield designs that can be mass produced at low-to-moderate cost. Such affordable, wideband antennas are of major importance to programs like multifunctional military systems or high-production commercial products where a single wideband aperture can replace several narrowband antennas, such as in digital radios and global broadcast satellites.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
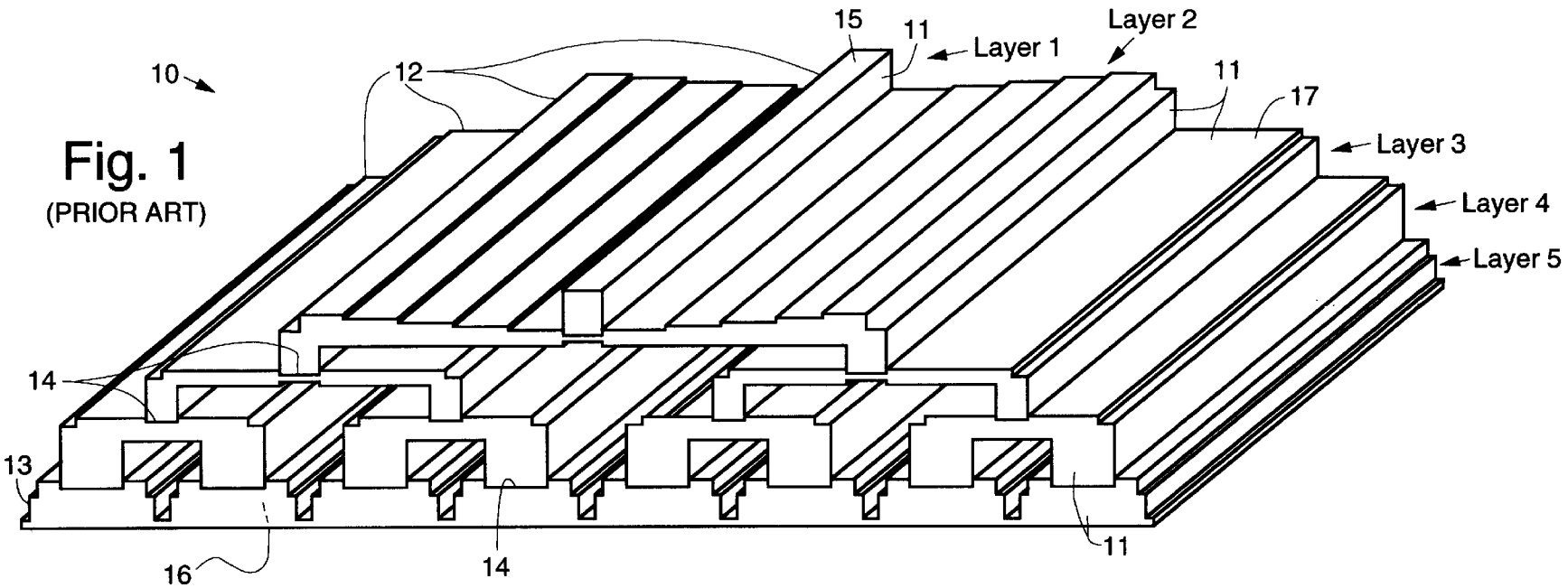
Fig. 1 (PRIOR ART)
FIG. 1 illustrates a conventional antenna made from machined dielectric parts that are bonded together and metalized.

Referring to the drawing figures, FIG. 1 illustrates a conventional true-time-delay, continuous transverse stub array antenna 10 developed by the assignee of the invention using the solid-dielectric approach discussed in the Background section. The array antenna 10 is made from machined dielectric parts 11 that are bonded together and metalized. The array antenna 10 operates satisfactorily over an extended band of 3.5 to 20.0 GHz.

Figure 2:
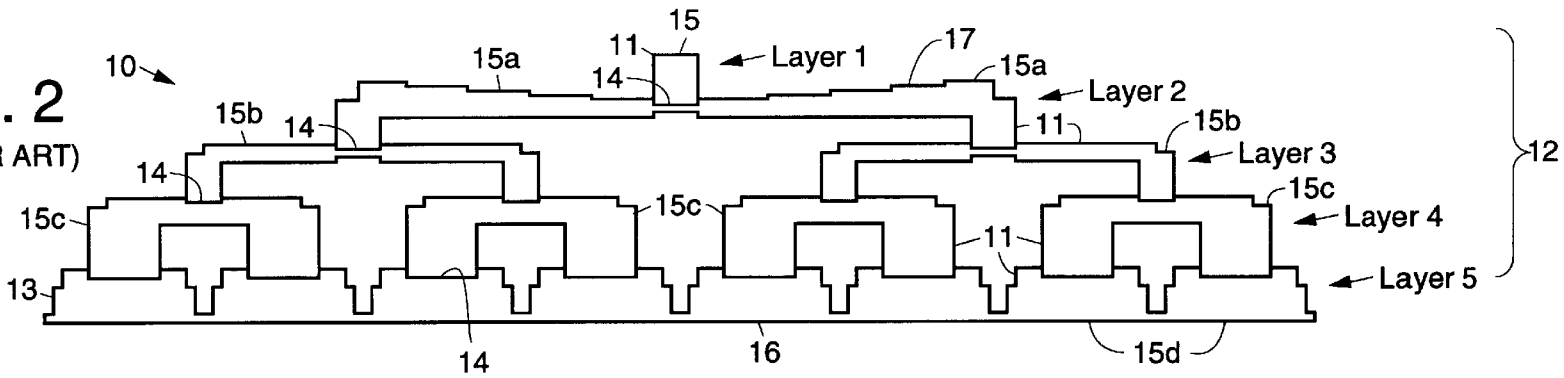
Fig. 2 (PRIOR ART)
FIG. 2 is a cross sectional side view of the antenna of FIG. 1.

FIG. 2 shows how a corporate feed structure 12 or parallel-plate waveguide structure 12 (identified as layers 1 through 4) and aperture plate 13 (layer 5) were constructed. Dielectric parts 11 of uniform cross section were made from Rexolite® 1422 using conventional machining techniques. The parts 11 were bonded together with adhesive 14 and then all outside surfaces (except a line-feed input 15 along the top surface of layer 1 and the radiating aperture 16 on the underside of layer 5) were metalized with a layer 17 of highly conductive silver paint.

Converting the solid-dielectric design of FIG. 1 to an air-dielectric version conceptually requires that the volume occupied by solid dielectric material be replaced by air, while surrounding voids are filled with a solid material to delineate walls of a parallel-plate waveguide. Where weight reduction is desirable, the voids can be partially filled, as long as the required degree of structural integrity is satisfied. The solid segments of material in FIG. 3 cannot be interconnected, except at the ends of the array antenna, without intruding into the parallel-plate waveguide region.

FIG. 2 shows a cross sectional view (not to scale) of the solid-dielectric array antenna 10 of FIG. 1. The antenna 10 includes the line-feed input 15 (layer 1), a first two-way power splitter 15*a* (layer 2), another pair of two-way power splitters 15*b* (layer 3), four more two-way power splitters 15*c* (layer 4) and eight continuous transverse stub radiators 15*d* (layer 5) fabricated as a single layer for structural integrity. The various pieces are grooved to make the assembly self-jigging for bonding. Because of the cantilevered construction of the two-way power splitters of the 15*c* antenna 10, only moderate pressure can be applied during bonding to assure that mating surfaces are joined without introducing air gaps. Because they would lie within the parallel-plate waveguide region, any gaps could seriously disrupt normal waveguide propagation, especially if intrusion by conductive material occurs.

Figure 3:
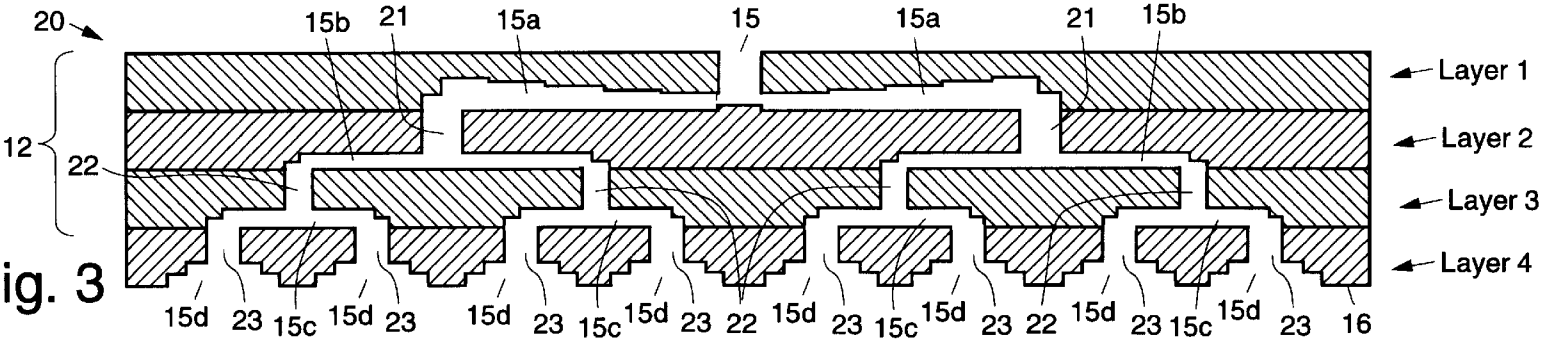
FIG. 3 is a cross sectional view of an air-dielectric true-time-delay, continuous transverse stub array antenna fabricated by a fabrication method in accordance with the principles of the present invention.

Referring to FIG. 3, it shows a cross sectional view of an air-dielectric true-time-delay, continuous transverse stub array antenna 20 fabricated using methods 30 (FIG. 5) in accordance with the present invention. In FIG. 3, the parting lines between layers of the antenna 20 have been removed in the air-dielectric regions so that the waveguide channels are more clearly visible. While all the same parallel-plate waveguide features of the conventional solid-dielectric antenna 10 are present, their allocation among the four layers is different. Layer 1 includes the line-feed input section 15 and upper and side walls of horizontal arms of the first two-way power splitter 15*a*. Layer 2 includes lower walls of horizontal arms of the first two-way power splitter 15*a*, two vertical waveguide sections 21 and, upper and side walls of a pair of second two-way power splitters 15*b*. Layer 3 similarly includes lower walls of the horizontal arms for the pair of second two-way power splitters 15*b*, four vertical waveguide sections 22 and, upper and side walls of four two-way power splitters 15*c*. Layer 4 includes lower walls of the four two-way power splitters 15*c*, eight vertical waveguide sections 23 and, eight continuous transverse stub radiators 15*d*. All of the microwave circuit features are accessible for inspection from at least one side of each layer before bonding. Also, a significant reduction in the weight of each layer can be realized by removing excess material that is not required for structural reasons.

Figure 4:
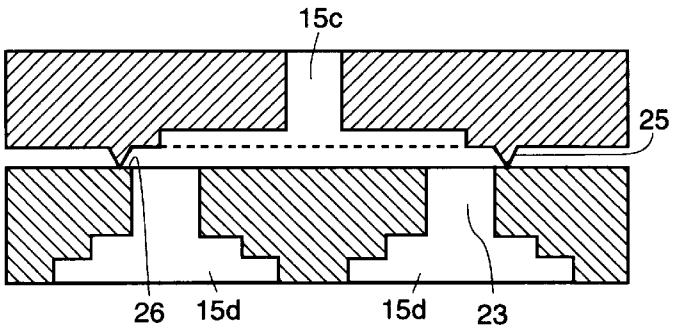
FIG. 4 illustrates energy directors employed in the antenna of FIG. 3 that are disposed adjacent to parallel-plate waveguide seams and that concentrate energy onto mating surfaces.

FIG. 4 shows in cross section triangular-shaped energy directors 25 that run adjacent to seams 26 of the parallel-plate waveguide structure 12 and concentrate ultrasonic energy onto the mating surfaces. Surfaces that have been metalized everywhere except directly over the energy directors 25 can be ultrasonically bonded. With proper design of energy directors 25, strong structural welded joints can be formed that provide continuous metal-to-metal contact along the seams 26 in the waveguide walls and are hermetically sealed.

The present invention provides for two methods of fabricating the air-dielectric true-time-delay, continuous transverse stub array antenna 20. The first method 30 uses conventional machining or molding techniques to form layers of plastic with the desired microwave circuit features that define each of the respective layers 1–5 and components described above. The layers are then metalized and bonded together, such as by using ultrasonic welding techniques. Typical metalization techniques that may be used in the present invention are disclosed in a brochure available from Crown City Plating, El Monte, Calif. entitled "Communications in Design", and typical ultrasonic welding techniques are discussed in an article entitled "Joining Plastics the Sound Way" by Frantz, J., Machine Design, Feb. 6, 1997, pp. 61–65.

The second method uses sheets of metal to form the respective layers 1–5 and components, into which microwave circuit features are formed, such as by machining. The layers are then assembled and joined together, using one of several available processes, such as an inert gas, furnace brazing technique, for example. An exemplary inert gas, furnace brazing technique is disclosed by Lentz, A. H. (coord. E. F. Nippes), in Metals Handbook, 9th Ed., vol. 6, 1983, "Brazing of Aluminum Alloys", pp. 1022–1032.

FIGS. 5–8 illustrate top, cross sectional side, and bottom views of layers 1–4, respectively, of the antenna shown in FIGS. 1–3. FIGS. 5–8 illustrate that each layer is constructed as a single structure. Structural elements shown in FIGS. 5–8 are the same as those shown in FIGS. 1–3, and are not shown therein.

Figure 9:
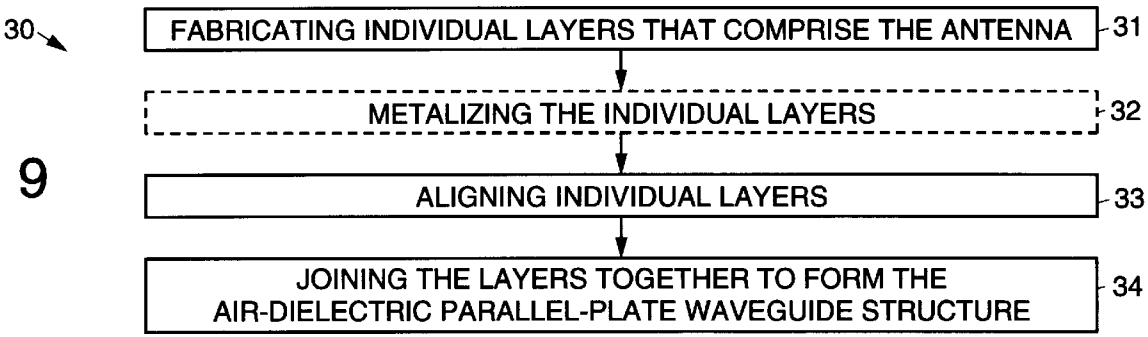
FIG. 9 is a flow diagram illustrative of methods of fabricating an air-dielectric true-time-delay, continuous transverse stub array antenna in accordance with the principles of the present invention.

FIG. 9 is a flow diagram illustrative of methods 30 of fabricating air-dielectric true-time-delay, continuous transverse stub array antennas 20 in accordance with the principles of the present invention. The first method 30 of antenna fabrication preferably involves ultrasonic welding plastic layers that have been metalized. This approach is particularly attractive for high volume, low-cost antennas where the various layers can be fabricated from ABS using conventional injection molding techniques. The metalization can be applied by a variety of processes, such as vacuum deposition, electroless plating, or by lamination during injection molding. This will be described in more detail below.

Figure 5:
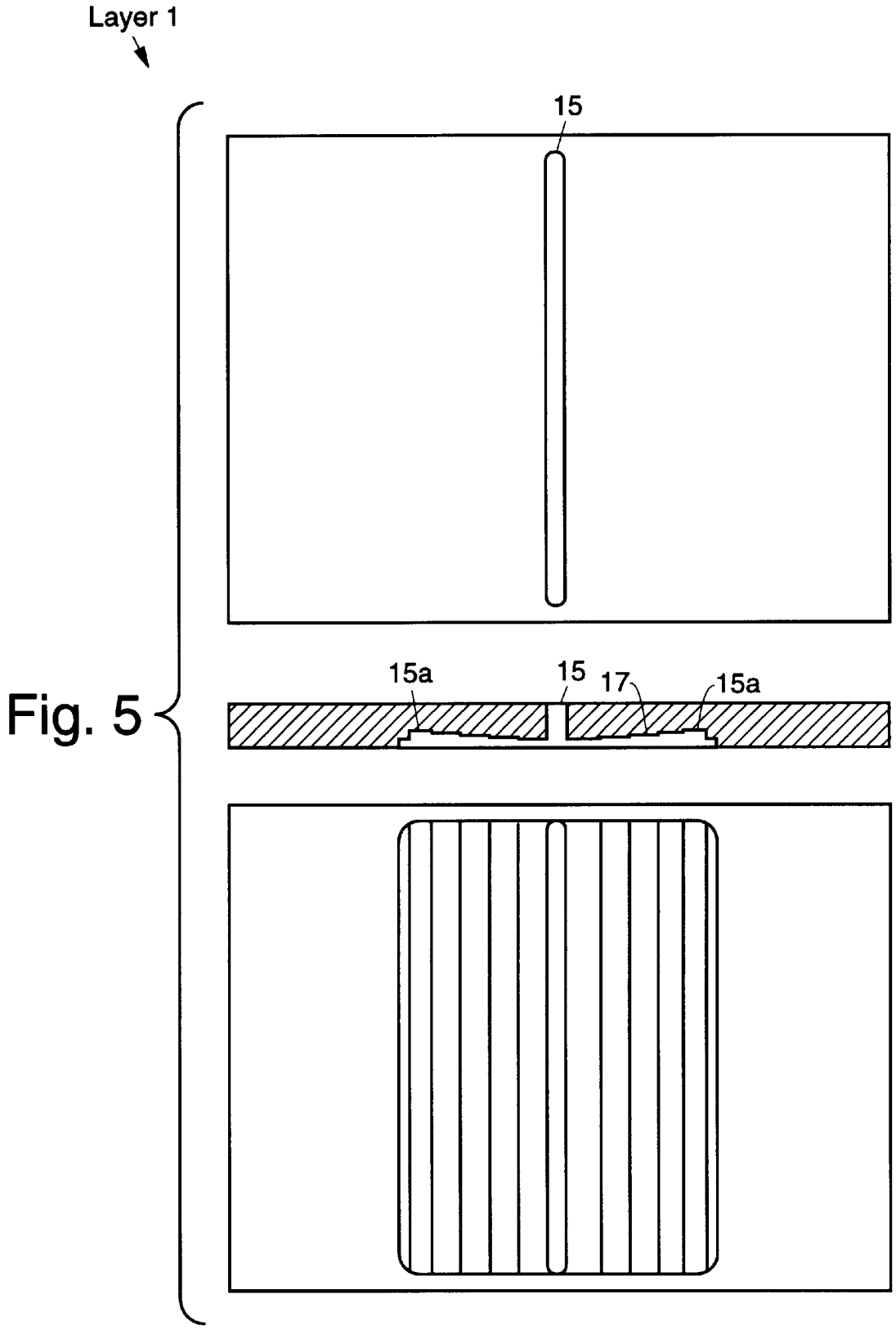
FIGS. 5–8 illustrate top, cross sectional side, and bottom views of layers 1–4, respectively, of the antenna shown in FIGS. 1–3.
Figure 6:
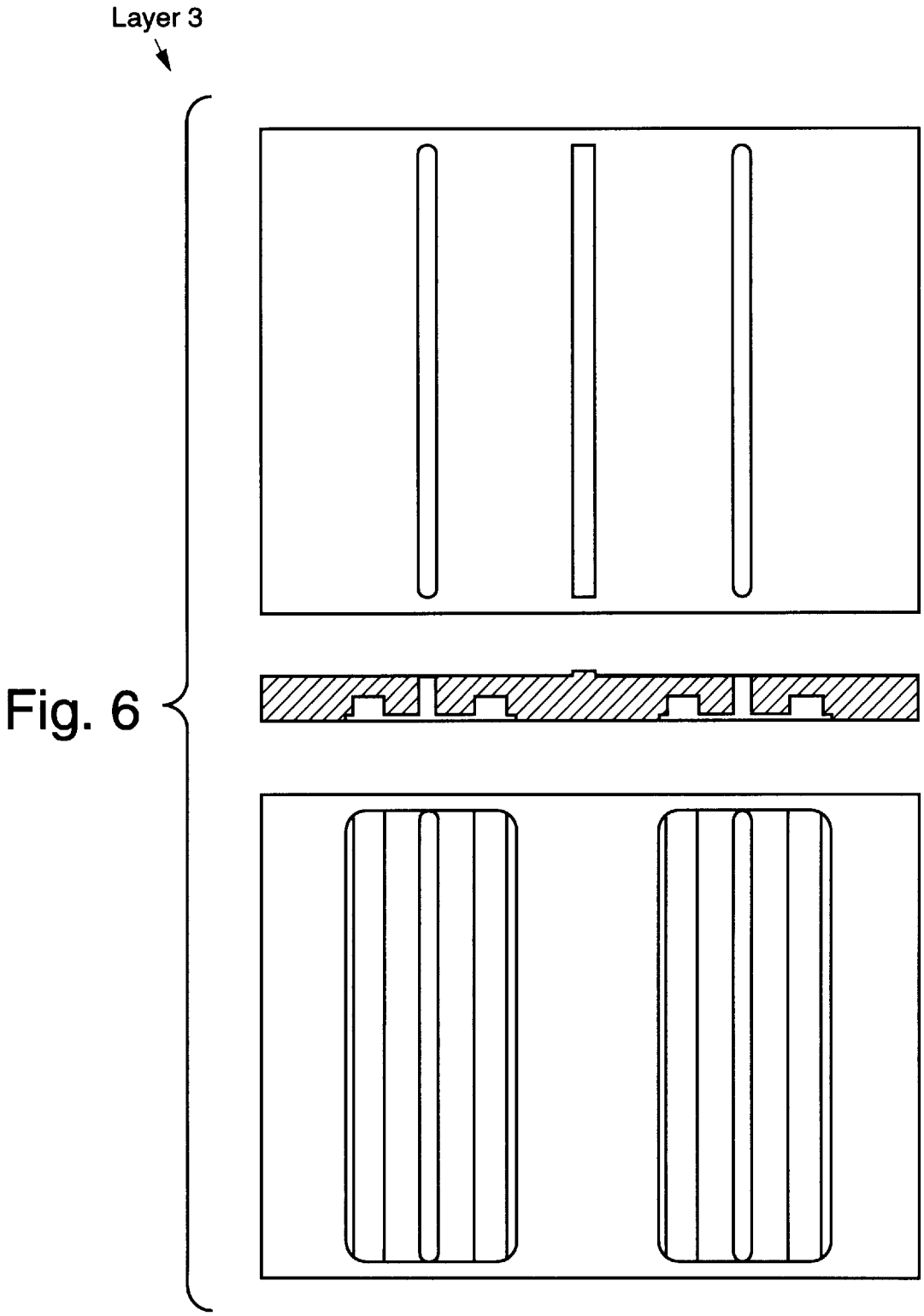
Figure 7:
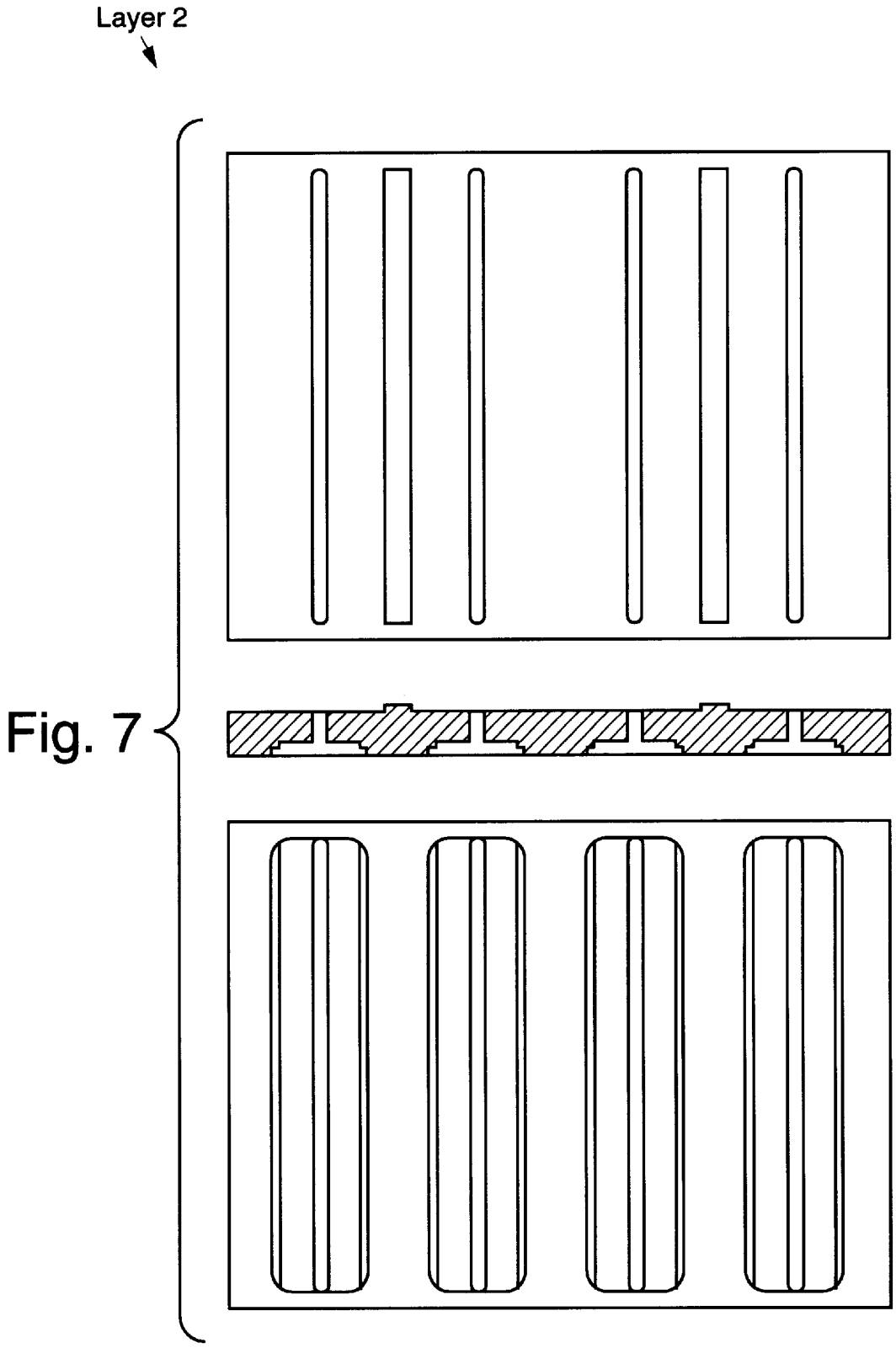
Figure 8:
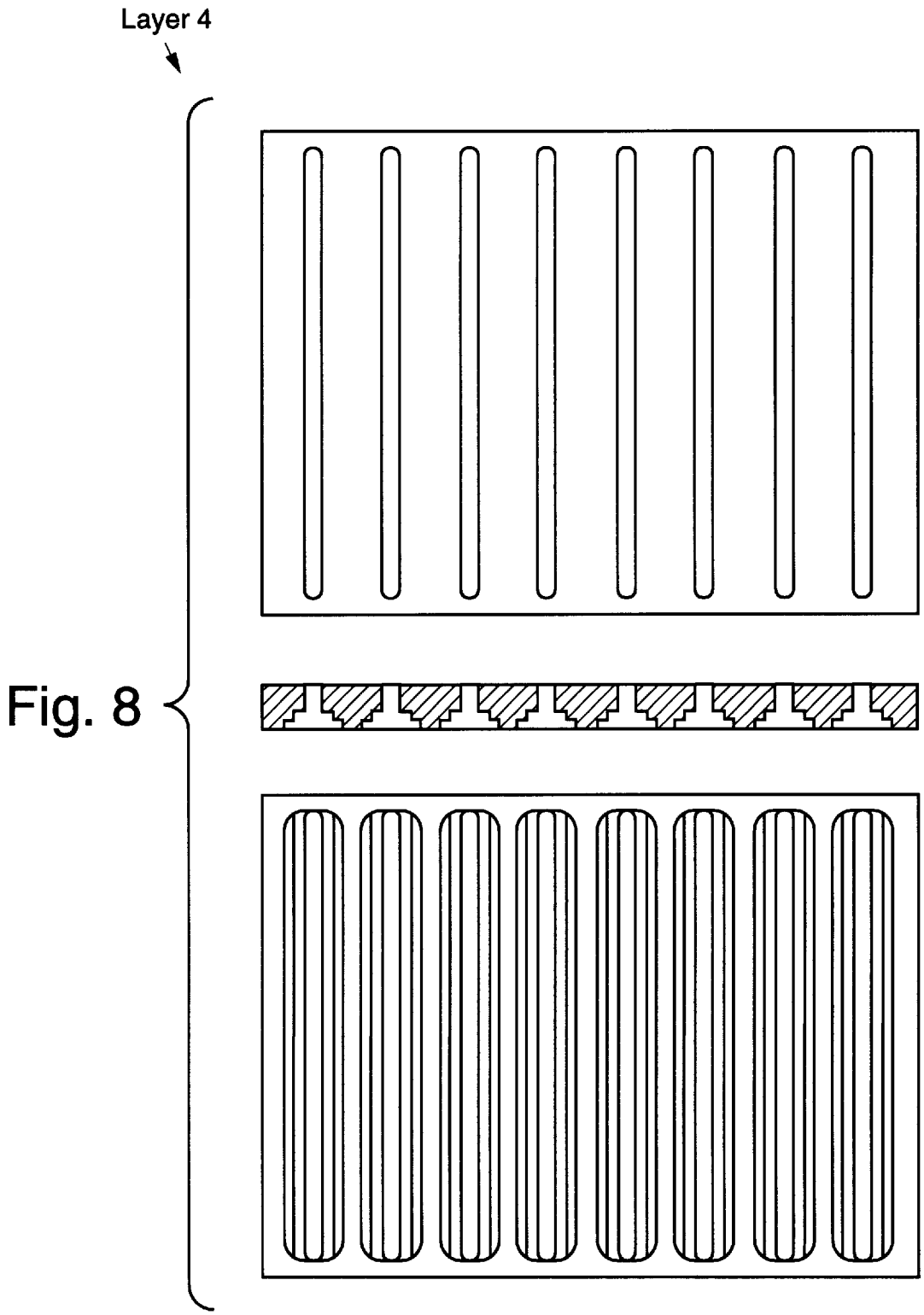

In accordance with one method 30, and referring to FIG. 5, individual layers are fabricated 31 and inspected, and are then metalized 32 if required, pinned for alignment (aligned 33) and bonded 34 or otherwise joined 34 together to form the air-dielectric parallel-plate waveguide structure 12. The methods 30 and sequence of steps used to fabricate the antenna 20 depend on whether the layers are made of plastic, such as aerylonitrile-butadiene-styrene (ABS) or polypropylene, or metal, such as an aluminum or copper alloy.

If the layers are made from plastic, then the surfaces that form the parallel-plate waveguide structure 12 are metalized 32 for good electrical conductivity across the operating frequency band. Standard microwave practice is to make the metalization at least three skin depths "δ" thick, with five skin depths "δ" preferred. Several options exist for metalizing 32 the plastic layers. These include using conductive silver paint, vacuum deposition, lamination and electroless plating. Any of these processes can be used to metalize 32 the internal parallel-plate waveguide surfaces before bonding 34 the layers together. However, electroless plating and, to a lesser extent, conductive silver paint are viable approaches after the bonding process 34.

Silver paint, which may be applied either by brush or spray gun, is usually reserved for breadboard designs or touching up areas such as seams 26 that might have been missed by other metalization techniques. The internal parallel-plate waveguide surfaces can be metalized 32 after bonding 34 the layers together by flowing paint through the parallel-plate waveguide channels; however, this process may not result in uniform coverage, especially in blind passages.

Vacuum deposition processes can be divided into two general categories: evaporation of metal atoms from a heated source in a high vacuum; and deposition of metal atoms from an electrode by the ion plasma of an inert gas at reduced pressure. Evaporation is a line-of-sight operation, while plasma deposition gives limited coverage around corners due to random scattering from collision of the particles. Either process is suitable for metalizing 32 the unassembled layers; however, neither approach is viable once the assembly has been bonded.

Metal laminated plastic sheets can be shaped using a process known as blow molding. Another technique is to place a metal-foil preform into a mold and inject hot plastic under pressure to form a laminated part. If the foil is thin and the mold is designed to eliminate sharp edges and corners, the process yields high definition parts.

Nonconductive materials such as ABS can be plated directly with the electroless process. A sequence of chemical baths prepares the surfaces and then deposits a stable layer of metal, usually copper or nickel. Electroless copper is limited in practice to a maximum thickness of about 100 microinches (2.54 microns), after which the highly active plating solution starts to react with fixtures and contaminates the bath. As 100 microinches represents only about four skin depths at 10 GHz, a thicker layer of metal is required to realize reasonably low conductor losses at higher operating frequencies. This is most often done by "plating up" the electroless layer using conventional electroplating processes. Electroplating is not practical in most arrangements of bonded assemblies for several reasons. First, a plating electrode is required that extends throughout the narrow parallel-plate waveguide channels, where inaccessible blind passages may exist. Second, the electric field is greatly enhanced at sharp corners causing a local buildup of metal, while diminished fields at concave surfaces will result in a sparseness of metal.

Any of the processes described above can be used to metalize 32 the unassembled plastic layers, which are key elements of the present invention. However, the best choice depends on particulars of the application. Bonding 34 the metalized plastic layers together will be described below.

There are four basic thermal processes for joining or bonding 34 plastics. The first and second are linear and orbital vibration, which generate frictional heat by sliding one plastic part against the other. The third is hot-plate welding, which uses a heated platen for direct thermal welding of the mating plastic surfaces. The fourth is ultrasonic welding, which uses high-frequency mechanical vibrations transmitted through the plastic parts to generate frictional heat. Ultrasonic welding is a preferred technique to bond 34 stacked plastic layers to form the air-dielectric parallel-plate waveguide structure 12 of the present invention. The process is fast, efficient, noncontaminating and requires no consumables.

The second method 30 of antenna fabrication uses machined aluminum layers, for example, that are brazed together. This approach is better suited for applications that can afford higher manufacturing costs in order to obtain close-tolerance microwave features and a more rugged mechanical design. Walls of the parallel-plate waveguide structure 12 may be electroless plated after brazing to reduce conductor losses. Thus, the layered construction of the present invention is well-suited to the use of layers fabricated from various conductive metals, particularly aluminum alloys, which can be furnace brazed together in an inert gas atmosphere such as argon, for example. Furnace brazing is usually reserved for aluminum alloys, which normally cannot be joined by lower temperature methods. Copper alloys, on the other hand, are most often joined either using a low-temperature lead-based solder, or are torch brazed using a high-temperature silver solder.

Thus, a true-time-delay continuous transverse stub array antenna and method of fabrication has been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A method of fabricating a true-time-delay continuous transverse stub array antenna, said method comprising the steps of:

fabricating individual layers that comprise the antenna;

aligning the individual layers; and joining the layers together to form an air-dielectric parallel-plate waveguide structure.

2. The method of claim 1 wherein the layers comprise plastic.

3. The method of claim 2 wherein the plastic layers comprise aerylonitrilebutadiene-styrene (ABS).

4. The method of claim 2 wherein the plastic layers comprise polypropylene.

5. The method of claim 1 wherein the layers comprise metal.

6. The method of claim 5 wherein the metal layers comprise an aluminum alloy.

7. The method of claim 5 wherein the metal layers are made of copper alloy.

8. The method of claim 1 which further comprises the step of metalizing the individual layers prior to alignment.

9. The method of claim 8 wherein the metalizing step comprises painting surfaces to be metalized with conductive silver paint.

10. The method of claim 8 wherein the metalizing step comprises vacuum depositing metal onto surfaces to be metalized.

11. The method of claim 8 wherein the metalizing step comprises laminating surfaces to be metalized.

12. The method of claim 8 wherein the metalizing step comprises electroless plating surfaces to be metalized.

13. The method of claim 1 wherein the joining step comprises hot-plate welding the layers together.

14. The method of claim 1 wherein the joining step comprises ultrasonically welding the layers together.

15. The method of claim 1 wherein the step of fabricating individual layers comprises machining metal layers, and wherein the step of joining the layers together comprises brazing the layers together.

16. The method of claim 15 wherein the metal layers comprise a copper alloy material.

17. The method of claim 16 wherein the metal layers are joined together using low-temperature lead-based solder.

18. The method of claim 16 wherein the metal layers are joined together by torch brazing using high-temperature silver solder.

19. The method of claim 15 wherein the metal layers comprise an aluminum alloy material.

20. The method of claim 19 wherein the metal layers are joined together using furnace brazing in an inert gas atmosphere.

* * * * *